US005136914A

United States Patent [19]

Letts et al.

[11] Patent Number: 5,136,914

[45] Date of Patent: Aug. 11, 1992

[54] STRINGED INSTRUMENT EMULATOR AND METHOD

[75] Inventors: James S. Letts, Long Beach; Randy D. Picolet, Los Angeles, both of Calif.

[73] Assignee: Gibson Guitar Corp., Nashville, Tenn.

[21] Appl. No.: 680,775

[22] Filed: Apr. 2, 1991

Related U.S. Application Data

[63] Continuation of Ser. No. 400,813, Aug. 30, 1989, abandoned, which is a continuation of Ser. No. 210,759, Jun. 23, 1988, abandoned.

[51] Int. Cl.[5] ..... G10H 1/06; G10H 1/38; G10H 7/00

[52] U.S. Cl. ..... 84/619; 84/622; 84/637; 84/DIG. 22

[58] Field of Search ..... 84/609, 610, 613, 619, 84/622-626, 633, 637, 638, 645, 649, 650, 657, 659-661, 665, 669, 685, DIG. 22, 267

[56] References Cited

U.S. PATENT DOCUMENTS

| | | | |
|---|---|---|---|
| 3,967,520 | 8/1976 | Drydyk | 84/DIG. 22 |
| 4,154,131 | 5/1979 | Studer et al. | 84/DIG. 22 |
| 4,476,766 | 10/1984 | Ishii | 84/610 |
| 4,513,650 | 4/1985 | Nagasaka et al. | 84/609 X |
| 4,624,170 | 11/1986 | Ohno et al. | 84/622 |
| 4,658,690 | 4/1987 | Aitken et al. | 84/267 X |
| 4,768,413 | 9/1988 | Fujimori | 84/609 |

*Primary Examiner*—Stanley J. Witkowski

*Attorney, Agent, or Firm*—Laney, Dougherty, Hessin & Beavers

[57] ABSTRACT

A music emulator for emulating guitar sounds uses non-guitar like devices, as for instance a piano style keyboard, for input. Input from the keyboard within a time window is defined as simultaneous and entered into a note list. A signal is derived from the note list indicative of the chord played on the keyboard. In addition, notes in the note list can be extended to form a full chord whereby as few as three notes constituting a chord input at the keyboard are extended to a greater number of notes as, for instance, the six strings of a guitar. This signal is then outputted at a time rate which is extended with respect to the input time window whereby the output emulates a guitar strum including an arpeggiation or strumming effect of a guitar like sound. Chord extension is achieved by analyzing the notes in the note list as to their pitch and generating further notes which are outside the typical one octave range of a keyboard chord and extend to the typical four octave window of a guitar.

11 Claims, 8 Drawing Sheets

STRINGED INSTRUMENT EMULATOR AND METHOD

This is a continuation of copending application Ser. No. 07/400,813 filed on Aug. 30, 1989 now abandoned, which was a continuation of application Ser. No. 07/210,759 filed on Jun. 23, 1988, now abandoned.

FIELD OF THE INVENTION

This invention relates to electronic music emulation and more particularly to an emulator for changing an input performance style to a different output performance style. As an example, chord style input ranging somewhat more than about an octave from a keyboard controller can be changed to the strum style of a fretted string instrument, such as the guitar, complete with its characteristic flam (arpeggiation) ranging over several octaves.

BACKGROUND OF THE INVENTION

The purpose of the present invention is to provide a means whereby musicians who possess facility with a keyboard instrument can simulate the techniques associated with a stringed instrument performance such as a guitar. There are certain nuances about the way notes are performed on a guitar that are difficult to emulate on other controllers, particularly keyboards. The guitar has at least two particular characteristic features about its performance which differ from a performance conducted on a keyboard. A guitar can be strummed and notes of a particular chord become an output as a timed sequence of notes rather than a simultaneous presentation of the notes of the chord. Also, the width of the voices of any particular chord played on a guitar is much broader than those of a corresponding chord played on a keyboard.

A guitar musician, in voicing a chord, can strum the notes of the chord as a time sequence. This is contrasted to a keyboard where the notes are played simultaneously with the five fingers of a hand. Thus, in playing a chord on a keyboard, normally all of the notes constituting the chord will be played simultaneously, or if sequence, much slower, as contrasted to the time sequence presentation of these notes with the guitar.

The delay in strumming a chord on a guitar is of the order of 10 to 15 milliseconds and is audibly distinct from either a simultaneous chord or a slow fingering. The nuance of strumming the notes or arpeggiating the notes rather than playing them simultaneously or slowly as a chord constitutes a very important musical characteristic of the guitar. This particular characteristic, while not impossible, is extremely difficult to mimic on a keyboard.

Attempts to mimic guitar strums on a keyboard require a quick rolling motion of the hand. Many keyboard players at some point in their careers have attempted to learn this technique; however, it is extremely difficult and unnatural. Further, in strumming a guitar the strum can either be down, up, bi-directional or repeated. Thus, it is simply not enough for a keyboard player to learn to roll the hand in one direction in trying to emulate a guitar. The keyboardist must attempt to become proficient in rolling in both directions. Because it is all but impossible even to master a rolling technique in one direction, emulation of a guitar strum is most difficult if not impossible for keyboard players.

The keyboard is limited in the width of the voice of a chord because of the constraints placed on it by the size of the hand. At best, the spread of a keyboardist's hand limits the individual notes of a chord to slightly over one octave. In contrast, the voices of a guitar cover a range of at least four octaves much of the time. The natural tuning of a six string guitar ranges across two full octaves from the lowest E string to the highest E string. Further each string ranges across essentially a further two octaves. In fingering of chords against the frets of a guitar it is not at all unusual for the guitarist to utilize this four octave range. This range in the guitar voicing is inherently unavailable to the keyboard player.

Accordingly, it is the principal purpose of the present invention to provide a method in an emulator apparatus for a keyboard musician or other music source, such as a computer, horn controller or other polyphonic instrument to play as though they had a guitar technique, including the altered voicings particular to the guitar and other string instruments and the arpeggiation or flam associated with the strum technique of a guitar. In this way the characteristic guitar sound, through an emulator, can be directly included within the group of instruments that can be simulated with a keyboard; so that, if a song or piece of music is written to call for or include a guitar, it is possible to emulate the guitar sound.

Electronic communication between a keyboards and synthesizers or other devices is facilitated utilizing a music industry standard communication reference known as MIDI. It is a further purpose of this invention to utilize this MIDI standard in emulating a guitar sound from a keyboard.

BRIEF DESCRIPTION OF THE INVENTION

The emulator or guitar emulating device of the invention is capable of producing guitar style performances from signals received from non-guitar style input devices and includes input means for receiving input electronic signals from the input device source, such as a keyboard controller. Emulator means is connected to the input means. The emulator means is capable of generating signals representing altered signals from the input signal with the altered signals having characteristics of a guitar style. The output of signals of the emulator are connected to the rest of the system through an output means.

The emulator means alters the signals to introduce arpeggiation into the signals for successive production of signals representing strumming of the notes of a chord and can provide chord extension for constructing new notes related in a defined manner to the notes of an input chord.

If new notes are introduced into the output signal the new notes would be related as to their pitch to the notes comprising the input chord notes and they can be further selected from notes in the same octave or different octaves from the octave or range of octaves of the input chord notes. For instance, new output notes could be selected to range in an octave range of two to four octaves whereas the input notes were in a range essentially below 1.3 octaves.

The means for outputing the altered signals can comprise a digital output device for outputing MIDI signals to a synthesizer which will then generate audio or can comprise a dedicated guitar voicing audio generator for directly outputing audio. Signals from the input device, i.e. keyboard controller, are received by the input means at a first input rate. For achieving arpeggiation (flaming or strumming) effects these signals are to be outputed at an output rate wherein the signal indicative of the individual notes are separated in time by an increased time increment compared to input signals. A stream of input signals can be concatenated during a threshold time window which selects signals at a first input rate. The signal is collected as notes in a note list. The notes thus collected in the note list are then outputed at another signal rate to introduce guitar nuances into the further output signal.

The signal indicative of notes of a chord in the output signal can be outputed serially, in particular orders indicative of guitar strummings, from low notes to high notes, or from high notes to low notes or even bi-directionally including both high and low strums. Further, signal can be outputed in response to both the receipt of signal from the input device and the termination of signal from the input device. Thus, a guitar like strum can be introduced into the output signal corresponding to the first striking of keys on a keyboard input device and also when pressure on these keys is released.

Additionally, notes in the note list from either the input signal or further notes generated in the note list in response to input signal can be transposed to emulate the configuration of the basic tuning of guitar strings or "barring" of these guitar strings. In reconfiguring the basic tuning, i.e. returning one or more of the guitar strings, the basic tuning of the guitar strings would be altered. In barring, each string in a basic configuration would be increased or decreased by a constant amount to reconfigure all of the strings by a constant increment.

This invention further includes a method for electronically generating a guitar like sound which includes generating input signals in response to input of chords on a keyboard input type device. These signals are collected within a time window and assembled in a note list. An output signal is generated from the note list and transferred to an output device as a time displaced serial signal stream wherein the time displacement of this output signal is greater than the time window selected for collection of the input signal. The method can further include outputing the signal from the note list in an order which is based upon the pitch of the notes in the note list and further, by expanding the note list to include further notes. The further notes would have the same pitch as the notes collected from the input but they would be displaced to a higher or lower note with respect to the octaves of the notes in the notes list.

In accordance with this invention, the electronic digital output signals will characterize the notes, the velocity, and the rhythmic pattern of a guitar style performance. This can be achieved by defining chords from the received input signal and generating output digital electronic signal defining predetermined guitar voicing including the number of frets, the strings, and the open tuning of each string and for converting each chord into at least one guitar strum over at least a portion of the open guitar voicing. Program means for selecting performance parameters can be selected from input note selection, grouping criteria, receiving modes, output note order, rate and MIDI channel selection.

BRIEF DESCRIPTION OF THE DRAWINGS

In the flow diagrams that are used herein circled entries identify functions, steps or processes, arrows identify data flow between functions and parallel lines identify data storage.

DETAILED DESCRIPTION OF THE INVENTION

Figure 1:
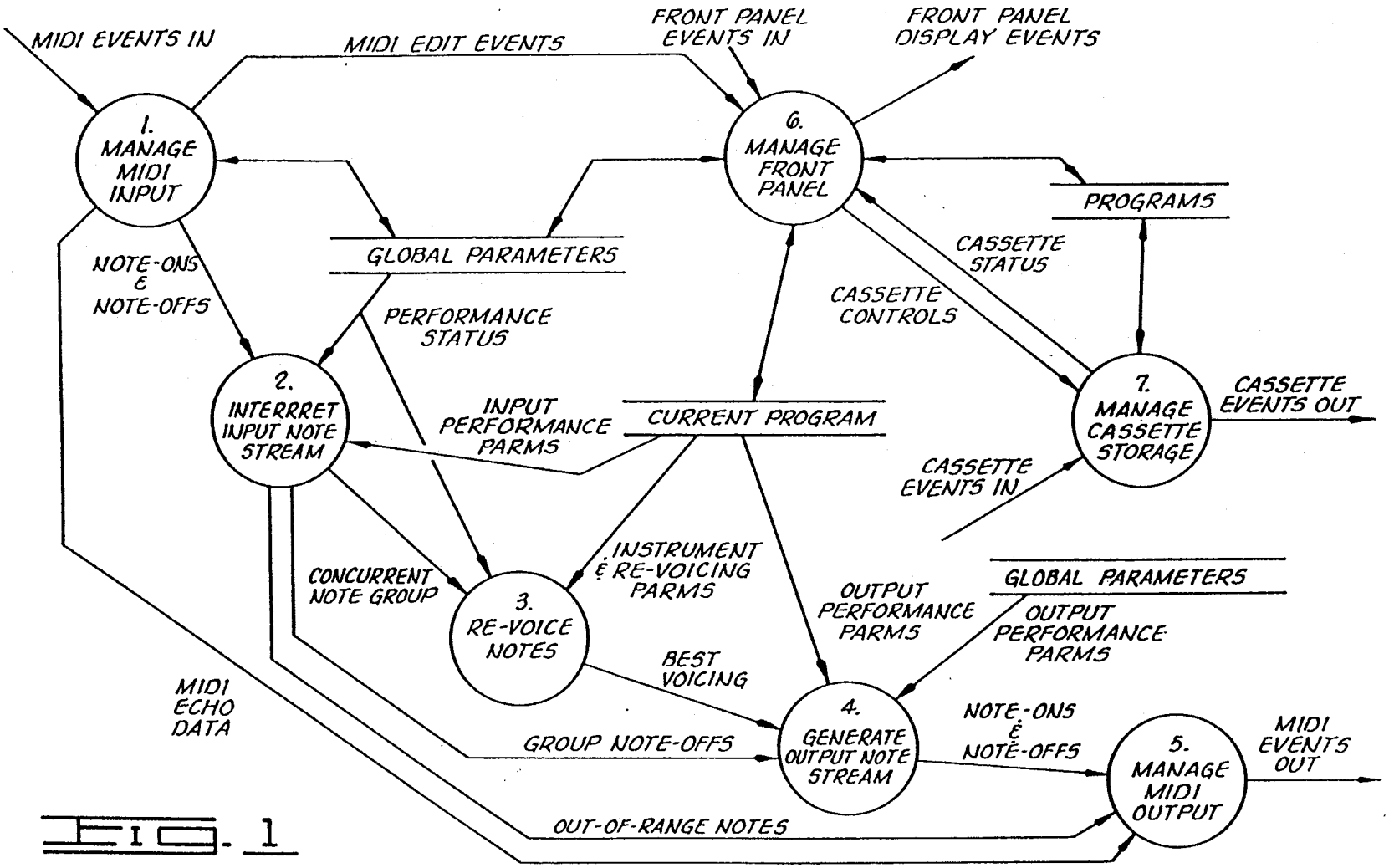
FIG. 1 is an overall flow diagram illustrating the method of musical event interpretation in accordance with the present invention.

When implementing the present invention advantage can be taken of an existing standard for interfacing with further musical apparatus and/or other electronics means. As such, the detailed explanation of the present invention is set forth herein with reference to the musical industry digital interface or MIDI specification for electronic connection between emulators, samplers, computers, controllers, sound generators and the like. MIDI provides the standard interface for interconnection, i.e. local area communication network (LAN) for emulators. The MIDI specification is set forth as a standard in the MIDI 1.0 Detailed Specification Document (160 pages) including addendum revision 3.3 (Sep. 1, 1986) which is incorporated herein in its entirety by reference.

A MIDI interface contains at least a receiver or a transmitter. A receiver interface receives messages through an optoisolator and a UART (Universal Asynchronous Receiver/Transmitter). The receiver recognizes MIDI format signals and executes MIDI commands contained therein. A transmitter originates messages in MIDI format and transmits through a UART and line driver. The guitar emulator of the present invention contains both the MIDI receiver section which is connected to a source such as a keyboard controller and a MIDI transmit section which is connected to the MIDI receiver of a sound generator. The guitar emulator of this invention contains programmed computer hardware for carrying out transformation procedures of the invention as will be explained.

MIDI itself operates to specify the character of digitized messages transmitted between as, for instance, emulators and related devices. Such messages include system messages, channel mode messages, and channel voice messages. The channel voice messages include note off, note on, polyphonic key pressure/after touch, control change, program change, channel pressure/after touch, and pitch blend change. The voice messages are modified in the guitar emulator of the present invention. In MIDI operation the standardized voice messages in particular are capable of carrying considerable musical information from one digital electronic device to another. The note on message signals the beginning of a note and is sent when the musician first presses down a key. The data includes in its message not only which key has been pressed but the attack velocity with which it is played.

The polyphonic key pressure message is used when the musician holds a key down. It relates how hard the touch is pressed into the key during the after touch.

The note off message designates when a musician releases a key and includes data on how quickly the key was released, i.e. the release velocity.

The control change message provides a variety of information about switch settings of the emulator. Also if the emulator has a foot pedal, a control change message can indicate when the pedal is depressed and when it is released to control various devices.

MIDI also defines a particular channel number so that messages can be identified both as to their source and destination when several MIDI devices are connected in sequence. As such information regarding the selecting of different pre-sets, for example, can be transmitted on a specific channel selecting a specific pre-set and any instrument listening to that channel would be switched to that selected pre-set. There is also information for controlling pedals and pitch bend levers and modulation controllers, some of which are well specified as, for example controller 1 almost invariably designates a modulation vibrato effect.

There are a variety of controllers, however. The MIDI interface is defined as though all controllers are keyboards. Some controllers may actually be similar to wind instruments, guitars or a variety of any other keyed instruments, but the pitch information from such controller is converted into an equivalent note number and transmitted as though a note had been pressed on a keyboard. The source of this control information could, of course, be a computer, so that a score written to a computer would be converted into a series of note on, note off events together with ancillary information all of which is transmittable by the MIDI specification. At the other end from the transmitter are any of a variety of receivers most of which will make a sound, although not always. They usually take the note information and cause a tone generator inside the receiver to produce an electronic signal, or in some cases a mechanical signal that produces sound, thereby controlled by the MIDI information. Of course the destination might even be a lighting control. While the receiver usually produces pitched sound, it should be realized that the MIDI signal in its usual form identifies a frequency at which certain audio complements should make a signal, even though that signal may itself not be pitched. For example the note number might specify the rate at which the signal gets louder and softer, although the signal itself is just noise, such as sh-sh-h-h. As a further extension the signal could result in switches being turned on and off at some specified rate or frequency, thus the MIDI specification does not dictate what must be done with the MIDI information but is a guideline for its use.

MIDI emulators, of course, do not have to operate in real time, and the data that comes in need not be one-to-one in correlation with the data that is to go out. For example, three notes may be played in at one time simultaneously and six notes in sequence may result, and the events that come out may indeed be related to events played sometime in the past since the accumulation of MIDI information for later performance is provided.

This guitar emulator provides an electronic device for musicians to produce guitar style performance from piano style keyboards utilizing piano style voicings and techniques. This allows for the achievement of guitar like sounds including strumming or arpeggiation as well as chord extension which include individual voicing over the range of octaves of the guitar.

For the purposes of this specification the invention will be discussed with respect to guitars. It is of course understood that the invention is straight-forwardly applicable to other stringed instruments which may or may not include fretting and which can be played by strumming and picking. This would include but is not necessarily limited to acoustic and electric guitars, double strung guitars, as for instance, the 12 string guitar, mandolins, banjos, and other stringed instruments whose sounds can be generated by strumming. For the purposes of describing the invention a piano type keyboard will be utilized for generation of the original chord voicing, however it is realized that other sources could be utilized, as for instance, any polyphonic instrument including other keyboard instruments, wind instruments, horn instruments and even computer generated chords. Irrespective of the source, the guitar emulators of the invention allows for altered voicings and arpeggiation of the input.

The keyboard or other input device can communicate directly to hardware thus creating a dedicated instrument wherein guitar performance is created from a keyboard or output can be transferred via MIDI to other devices. Further, the invention can be incorporated into complex devices wherein the guitar emulation only constitutes a portion of the operation of the device. Such devices would include the option to select guitar emulation or to bypass guitar emulation. Thus, transformation of input can be made to select the guitar emulation or signal can simply be passed through without generation of guitar emulation. Further, special effects can also be achieved with the invention, as for instance a one shot arpeggio of an input signal or the like.

For the remainder of this specification it is to be understood that a piano keyboard is utilized, by way of example, to generate input and this input is transferred to a device of the invention utilizing the MIDI standard. As such voicing information will be transferred utilizing standard MIDI communication protocol with a 1 start bit, 8 data bits and 1 stop bit. This communication is done over a serial communication line and is unidirectional from the input device to the output device. This is done utilizing standard UARTs as a communication controller. The command specifications include note on/note off corresponding to the individual keys pressed on the input key board as well as reference to one of the 16 allowed particular channels in the MIDI protocol.

Further, the notes on and notes off also include velocity codes to indicate how quickly the key was depressed or released. Additionally, preset information can be transmitted to the different channels allowing for any particular channel to listen and interact under its own preset selected parameters. Output from the guitar emulator of the invention is to a further emulator or sampler for creation of the actual guitar like audio. As such, output of the guitar emulator of the invention will contain audio information to be used by a downstream emulator or sampler. It is understood, of course, that the guitar emulator of the invention could be built into a dedicated device which would include means for directly generating an audio output.

A chord is defined by at least three voices. A normal guitar, however, includes six strings, e.g. E, A, D, G, B and E. A technique of the invention, herein after referred to as chord extension, takes advantage of all or part of the six strings of a guitar. Using chord extension of the invention a three note input to the guitar emulator of the invention is expanded to an output of six notes, i.e. a six voice output, to include all six strings of the emulated guitar in the chord. Because of certain fingerings and other characteristics of particular chords, for certain chords not all of the strings may be utilized. Thus, combinations of 6, 5, 4 or 3 strings might be output by the guitar emulator depending upon the particular chord played, the location of the fingering on the frets of the guitar in for the emulated guitar chord and the like.

In strumming a chord on a guitar, the individual strings are strummed with a delay of approximately 10 to 15 milliseconds between each individual string. Thus on a guitar the individual notes of a chord are played in a sequence. Normally in playing a chord on a keyboard, all of the keys are theoretically struck simultaneously. This simultaneous playing of the individual notes of a chord on a keyboard is mitigated when an input from a keyboard is transferred utilizing MIDI. Since the MIDI protocol utilizes serial propagation of input information, the individual notes constituting the keyboard generated chord are, in fact, not received simultaneously. The MIDI standard utilizes bit transfer at about 30K baud. This rate is much too fast for a human ear to discriminate.

Since the notes of a chord are transmitted serially over MIDI, for a guitar emulator of the invention a time window is established wherein receipt of signal for individual notes of a chord within the time window is considered as being generated simultaneously and the guitar emulator of the invention then processes the signal received in the time window. When signal characteristic of these individual notes is output, output is also serially but it is effected utilizing a delay between the notes characteristic of that necessary to achieve an audibly perceivable strumming effect of the guitar. Additionally, the three notes or voicings which make up a chord and which are received during the time window can be expanded to six by the chord extension of the invention and while only three notes were played, the output signal will include up to six separate voices separated in time.

In playing a chord on a keyboard, because of the layout of the keyboard and the width or spread of the musician's hands the voicing of the notes will range over an octave or less, typically no greater than an octave and a third. This is contrasted to a normal guitar tuning where each string generally has a two octave range and the tuning between the highest string and the lowest string spans a further two octaves. Thus as a practical matter in emulating guitar sounds individual notes or voicings from the emulated guitar sound will be located within about four octaves, i.e. four semi-tones, between the high and the low. Theoretically an even greater range of octaves is possible by returning and the like.

It is evident that the dramatic increase in range from about one and a third octaves for the keyboard to about four octaves will result in a dynamic change in the voicing of an output sound utilizing the guitar emulator of the invention.

A sound input from a keyboard to a guitar emulator of the invention utilizing MIDI protocol will be first analyzed to see if the channel on which the guitar emulator is on has been selected. Assuming that channel select is for guitar emulation, the data in the serial data stream will then be further processed to determine if individual notes of a chord are within a threshold setting of a selected time window. The time window is selected to be indicative of the individual notes of a chord being played essentially simultaneously on the keyboard and then received serially over the MIDI connected line within the selected threshold setting.

The guitar emulator of the invention can further include means for checking for notes within a certain range. This allows a keyboardist to play chords with one hand which will be converted to guitar like sounds by the guitar emulator while playing notes on the other hand, which will not be converted, as for instance, bass notes and the like. Thus, the bass notes being out of a preset range of notes will be transferred to the output MIDI line in an unaltered state and only those notes within selected the note range will be altered by the guitar emulator.

Having ascertained that the signal is on the guitar emulator channel, that they match the "key zone" or control zone, and that they have been accumulated within a threshold time, the notes are then accumulated into a play note list.

The first note coming into the guitar emulator is echoed out immediately in order not to induce time delays between the keyboard and the output device. This first transition from a no note state to an on note state thus gets played immediately. The other notes, however, are accumulated during the time window in the note list until an indication comes over the MIDI transfer line of a further no note state.

A normal guitar can be played in either open tuning or in barred tuning. In the open tuning the lowest note for each string would be that of the unfretted string. In a barred tuning the lowest note of each string would be set to a particular fret. For an actual guitar, mechanical devices are available for barring the guitar at various frets to achieve various barred tuning.

Chord extension of the invention can include emulating both open tuning or barred tuning of a guitar. Incoming signal is analyzed not only to ascertain the presence of a chord and which specific chord is being played, but if in fact, the chord is being played higher up on the neck of the virtual guitar which is being emulated on the keyboard. This is achieved by looking at each of the theoretical strings of an emulated guitar and deciding what of the actual notes which have been input to the guitar emulator should be played on which strings and on what fret.

In an open tuning mode of the guitar emulator of the invention, the base tuning of the guitar would be utilized for note and octave selection. If it is desirous to play the emulated guitar higher up on the virtual neck of the emulated guitar, the fret at which the guitar is to barred is entered into the protocol of the guitar emulator of the invention and all notes then transposed with respect to this base.

As noted above the guitar emulator of the invention, as a practical matter, works in a range of transposition of about four semi-tones. A received note is compared to see if it corresponds to an open string and if it does not correspond to an open string then it is transposed up along the string to find the correct note. This is done for each of the notes received. This matches the pitch, but not necessarily the octave. The pitch is simply the note number modulo 12.

The octave can be determined by assigning one of the emulated strings as a control string, as for instance the first string corresponding to a note received over MIDI, the lowest string or the highest string. Its pitch is then assigned and from this the assignments to the other strings can be made accordingly. Thus, if for instance, using the lowest string as the controlling string, its pitch is assigned to the third fret. The guitar chord indicated would thus be a barred chord at fret 3 and all other strings could be transposed with respect to achieving the desired chord barred at fret 3.

Further, the guitar emulator of the invention can allow for selective tuning of the strings. Thus in both a bar mode and an open mode the strings will change in predictable ways for a given chord and accommodate transposing up or transposing down of the chord. This allows for chord extension to achieve pitch and octave number from information extracted from the note play list.

By incorporating channel select several different independent tunings can be selected and utilized in an appropriate control device as for instance a foot pedal device or the like. The resulting notes from different chords can be sent to different destinations to simulate the effect of several discreet guitar like devices.

Each of the notes in the note list is examined for the closest possible match in pitch where the pitch is defined as the note number modulo 12. This is constrained by the requirement that any negative transformations may not be used and that all transformations must be within the range of 4 semi-tones as noted. If a note results which would be out of these above ranges no corresponding note is generated.

In the barred mode all the strings are simultaneously transposed by a certain amount with additional transpositions on certain of the strings to generate the desired chord. In the bar mode either the lowest or the highest numbered note can be assigned as a first note in the base note list. From this an initial transposition is calculated and then this transposition is added to all other notes in the base note list. The remaining notes in the list are taken in turn and for each the closest pitch in the play note list is generated such that only positive transpositions less than the above referred to 4 semi-tones for the modified base note list is used.

A guitar like instrument can be strummed with an ascending or descending stroke, down or up, that is from low to high or from high to low. Thus a scanning direction can be involved. The guitar emulator of the invention can modify the scanning direction by inverting it, repeating it, or changing it in real time with the use of an auxiliary pedal or other input device. Thus, a chord played on the input keyboard instrument can be output either as a high to low strum or a low to high strum or a series of transformations of low to high, high to low and the like.

Further, the guitar emulator of the invention is responsive both to notes on and to notes off. Thus, a first strum can be output in response to receipt of notes on and upon receipt of notes off, a further strum can be output. These can both be in the same direction, such as down-down or they can be reversal such as down-up. This allows for the input of a single key stroke on the keyboard being output by the guitar emulator of the invention as multiple guitar strumming sounds of either down strokes, up strokes or bi-directional reversals to achieve various guitar strumming effects. Such effects would be all but impossible to directly achieve on a keyboard and in the absence of the guitar emulator of the invention can only be achieved on an actual guitar instrument.

The MIDI standard allows for input of velocity information over the connecting cable between an input and an output instrument. This can be used by the guitar emulator of the invention. Thus, it is possible to select either the highest velocity of the cluster of notes in a particular chord played on a keyboard input device or the lowest velocity to govern the output of the guitar sound from the guitar emulator. If the low velocity was selected the softer the musician played on the keyboard the slower would be the strumming speed of the guitar sound output by the guitar emulator. Conversely, if the highest velocity was selected the opposite effect is output.

The velocity of the notes generated by chord extension can also be scaled. This is effected according to their proximity to actual notes. The notes closest to those actually found in the play note list are loudest while further notes which have been synthesized are quieter. The reference point for this can be defined as the first note which is scanned in the play note list and thus it can be made to be dependent upon the scan direction.

Output information for emulating a guitar can be propagated to an appropriate output device for creation of actual audio characteristic of the guitar. Output can be effected utilizing MIDI. This allows for emulation of certain basic guitar characteristics from a keyboard or other input devices by modifying the input from these devices to incorporate both the strumming and voicing of a guitar as well as the octave range of the guitar. This essentially correspond to a MIDI in, MIDI out device wherein the input is made in keyboard or other voicing and the output is in guitar voicing.

The principles of the invention can also be utilized with a dedicated guitar emulator which would allow for emulation of further guitar characteristics such as hammering on, note decay produced by the guitar string, string harmonics and other particulars of a guitar such as typical finger squeakings and the like which are typical of guitar performances. While a standard emulator utilizing a MIDI protocol will respond to start of note, stop of note, blend of pitch, sustainment of the note, the addition of vibrato and changing pitches, other characteristics can be implemented in a dedicated guitar emulator. If a guitar emulator of the invention is built into a sampler or emulator, further guitar nuance can be incorporated into such a dedicated device. This allows for highly sophisticated guitar voicing utilizing standard keyboard input.

Figure 2:
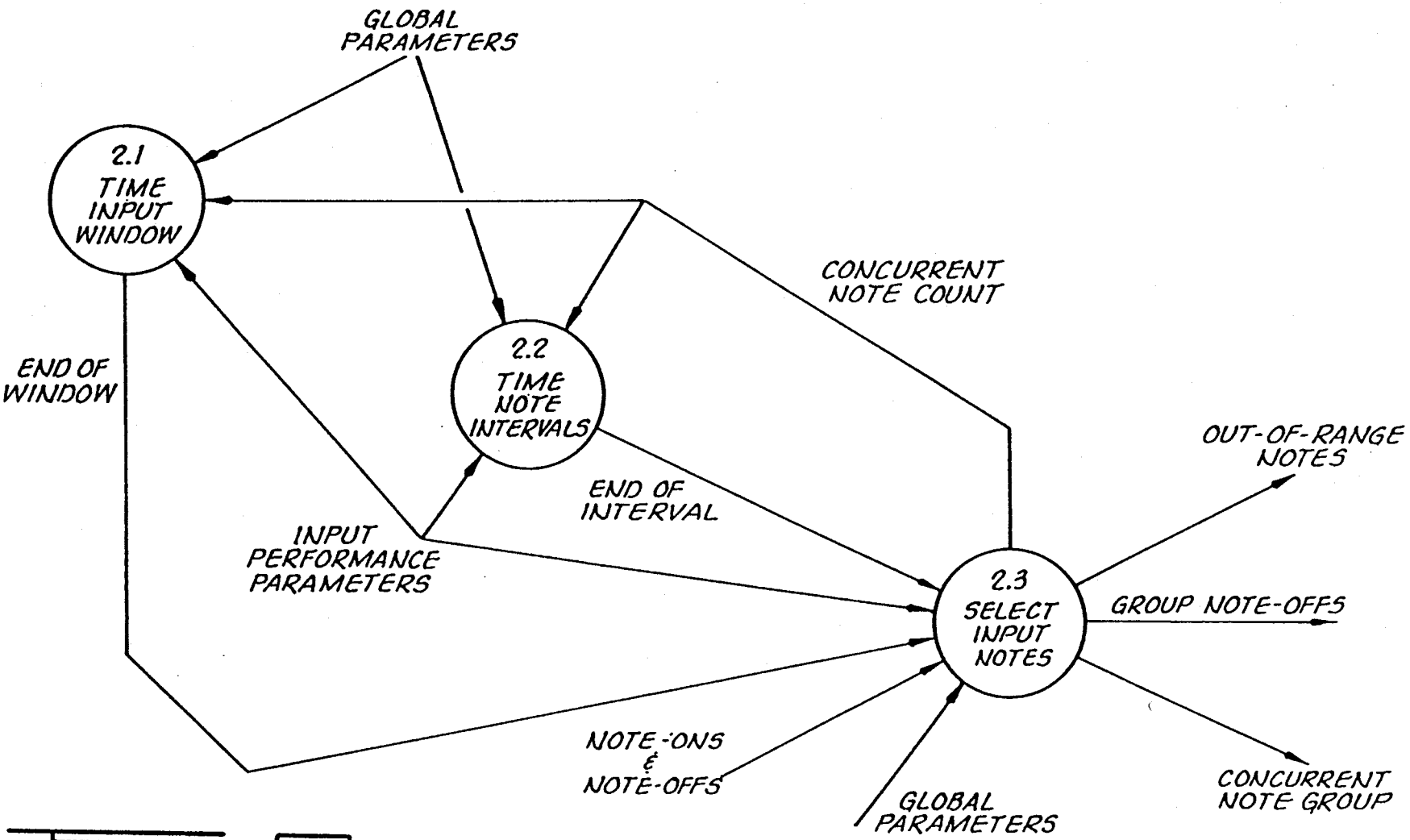
FIG. 2 is a flow diagram of the input window and note selection process of the present invention.
Figure 3:
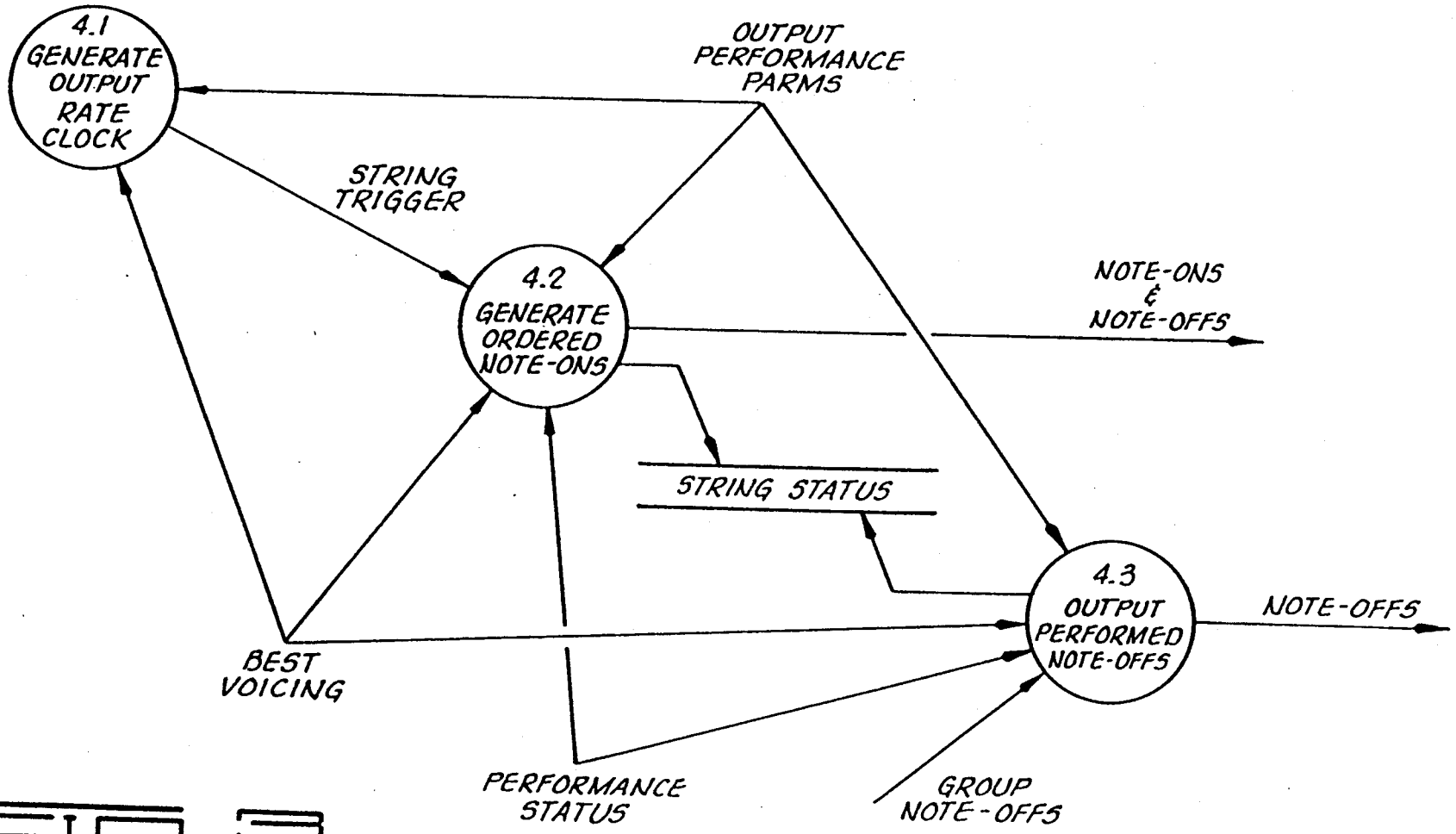
FIG. 3 is a flow diagram of the output window and note grouping process of the present invention.

The flow diagrams of FIGS. 1, 2 and 3 are illustrative of the invention. As an aid to understanding the flow diagrams of FIGS. 1, 2 and 3 and the pseudo code programming set forth, certain definitions pertaining to the terminology of the Figures and the referenced pseudo code are given in an alphabetical listing in Appendix A.

In FIG. 1 at 1 determination is made as to whether or not the guitar emulator is in cassette, edit or other mode. In cassette mode all processing of MIDI event input is disabled. In edit mode, incoming notes on and controller changes are routed for editing events and all other MIDI is echoed to output. When not in cassette or edit mode, note on and note off is routed for interpret note stream input. In FIG. 2 at 2.1 an input window is generated to define input data which is considered simultaneous even though the notes were not received simultaneously because of the serial MIDI input stream. At 2.2 the note interval between notes is timed and at 2.3 the notes are selected within the time window which are within the range to be processed.

Revoicing is done at 3 for selected pitch, strum direction and other revoicing variable. The output note stream is generated at 4 (FIG. 3) with the clock rate specifically generated at 4.1, the note order at 4.2 and corresponding notes off and string status is updated at 4.3.

If not in the cassette mode, at 5, the notes on and notes off are merged with out of range notes and MIDI echo data. Program selection, visual feed back and the like are indicated at the front panel at 6 and cassette management at 7.

The program is particularized by the user before performance by setting of front panel switches on a device running the same. Sufficient memory is utilized for multiple performance sub-programs, each having three main parts; normal performance parameters, alternate performance parameters and instrument definition.

The normal and alternate performance parameters are identical in structure, but the alternate parameters are invoked during performance in real time by the use of an external pedal or a MIDI controller. The performance parameters define output notes, selection and group criteria, revoicing modes and output note order rate and MIDI channels.

The instrument definition allows the specification of the number of frets and strings as well as the open (unfretted) tuning of each string. At performance the user selects a program from the front panel of a device running the program or via a MIDI controller and then the user enables/disables the processing of the MIDI performance data from the front panel or by an external pedal or MIDI signal. While enabled, all performed note data (on the selected MIDI channel) is scanned and transformed according to the normal or alternate parameters of the selected program, as appropriate. The musician then simply plays familiar chord voicings in the desired rhythmic pattern on the keyboard and the present invention converts the performance into that of a string instrument. When disabled the apparatus simply echoes all incoming MIDI data to the output so as to provide a bypass mode.

Utilizing the above noted criteria an operating program can be set forth as per the hierarchical pseudo code of Appendix B. The program of the present invention set forth in the hierarchical pseudo code is structured for ready implementation in a specific high level language such as Pascal or C which may then generate machine code with a suitable compiler.

For the hierarchical pseudo code of Appendix B, cross reference can also be made to FIGS. 1, 2 and 3 wherein cross referencing numerals are utilized to relate the code and the figures.

Figure 4:
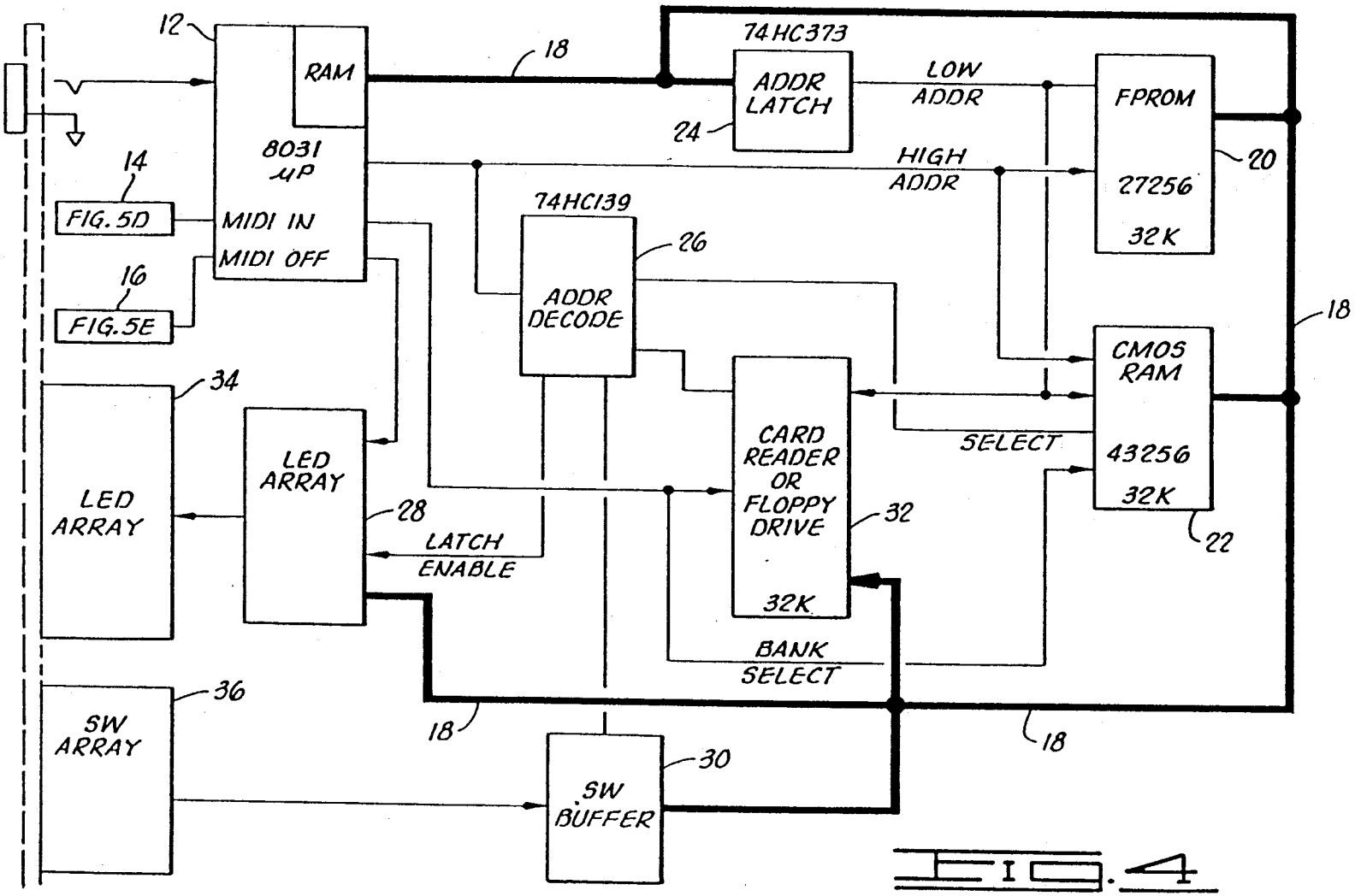
FIG. 4 is a block diagram of a computer circuit adapted for use in executing the procedure of the present invention.
Figure 5A:
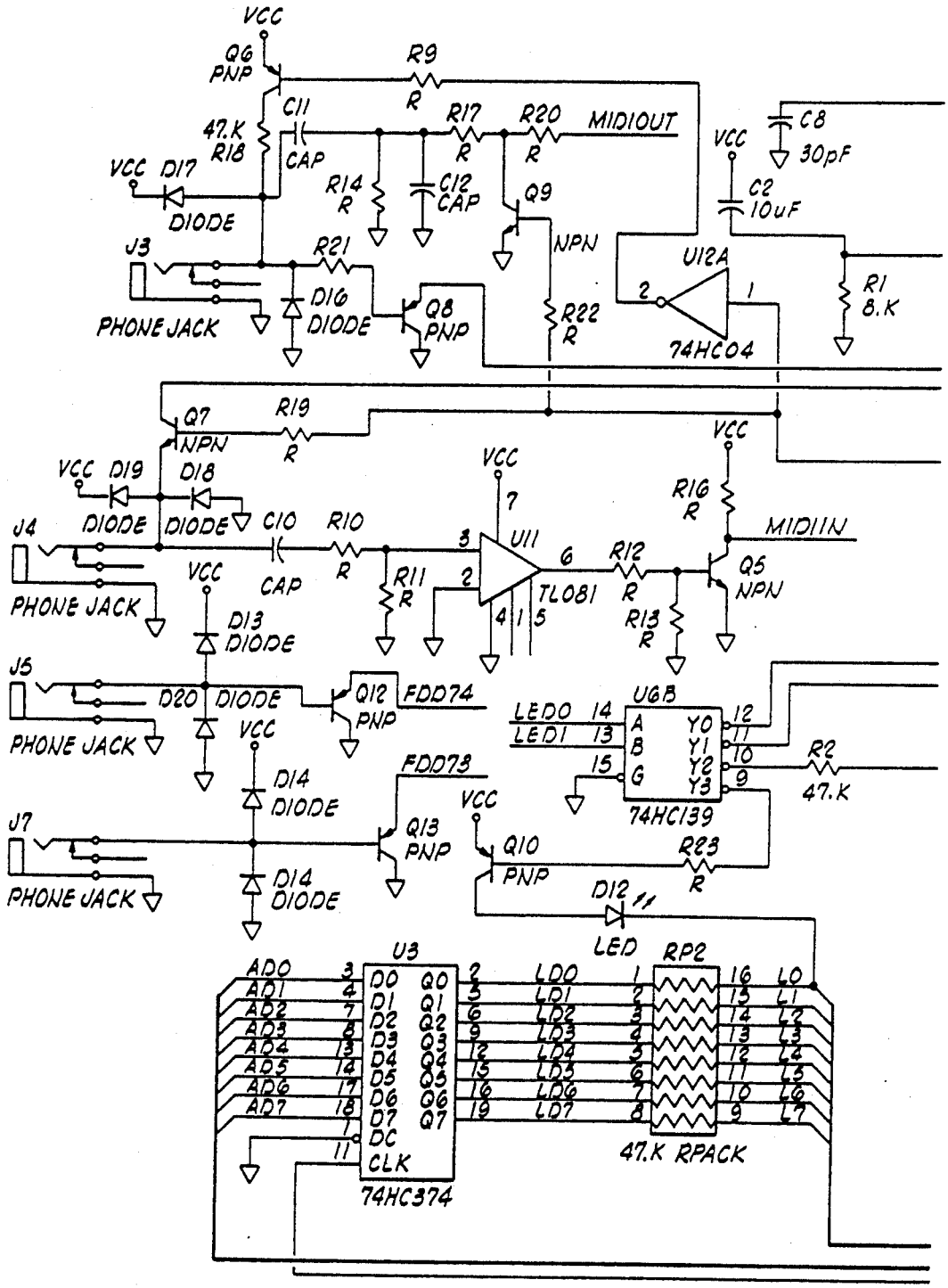
FIGS. 5A, 5B, 5C, 5D, and 5E are detailed schematic diagrams of electronic circuits corresponding to the block diagram of FIG. 4 for storing and implementing the procedures of the present invention.
Figure 5B:
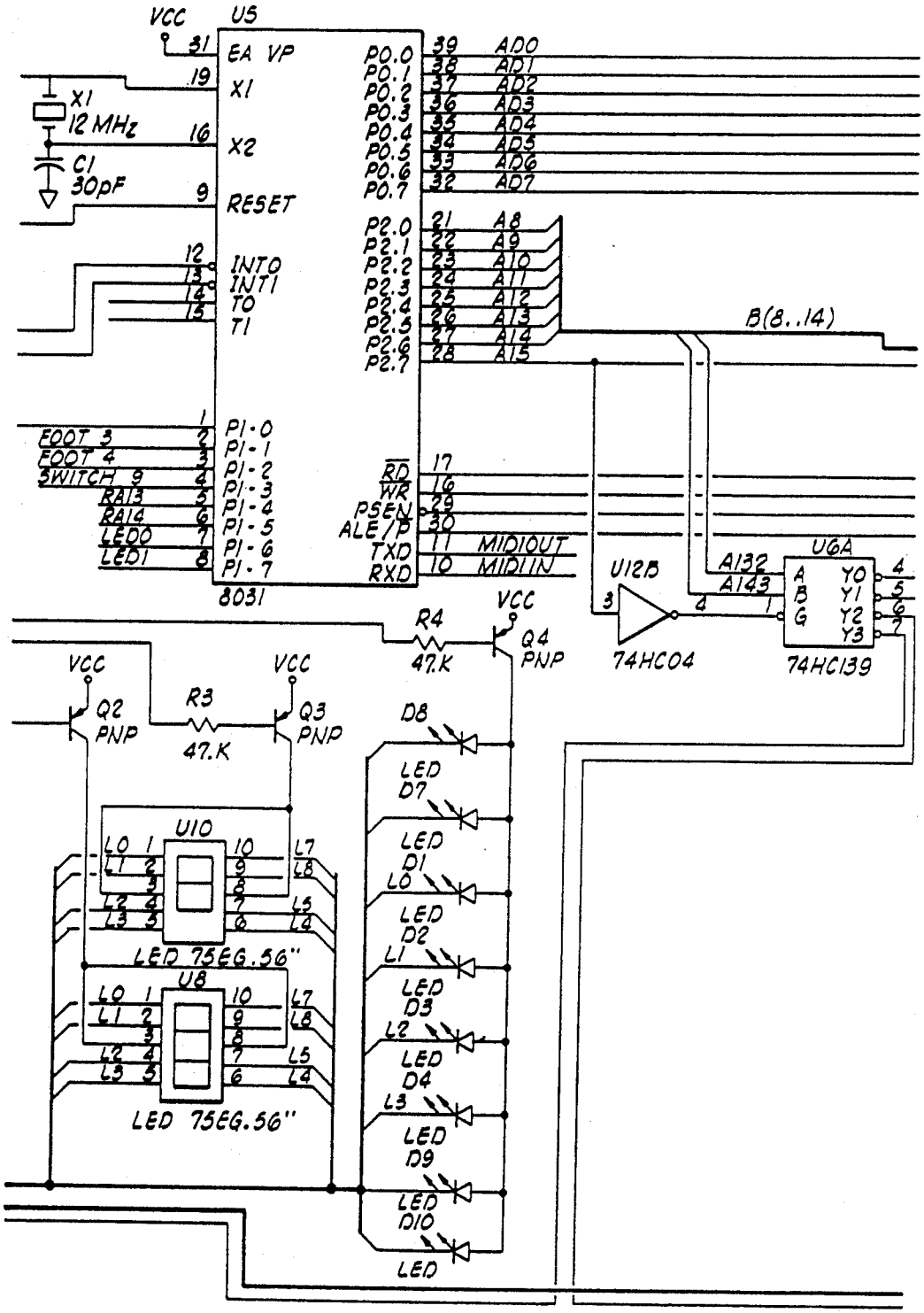
Figure 5C:
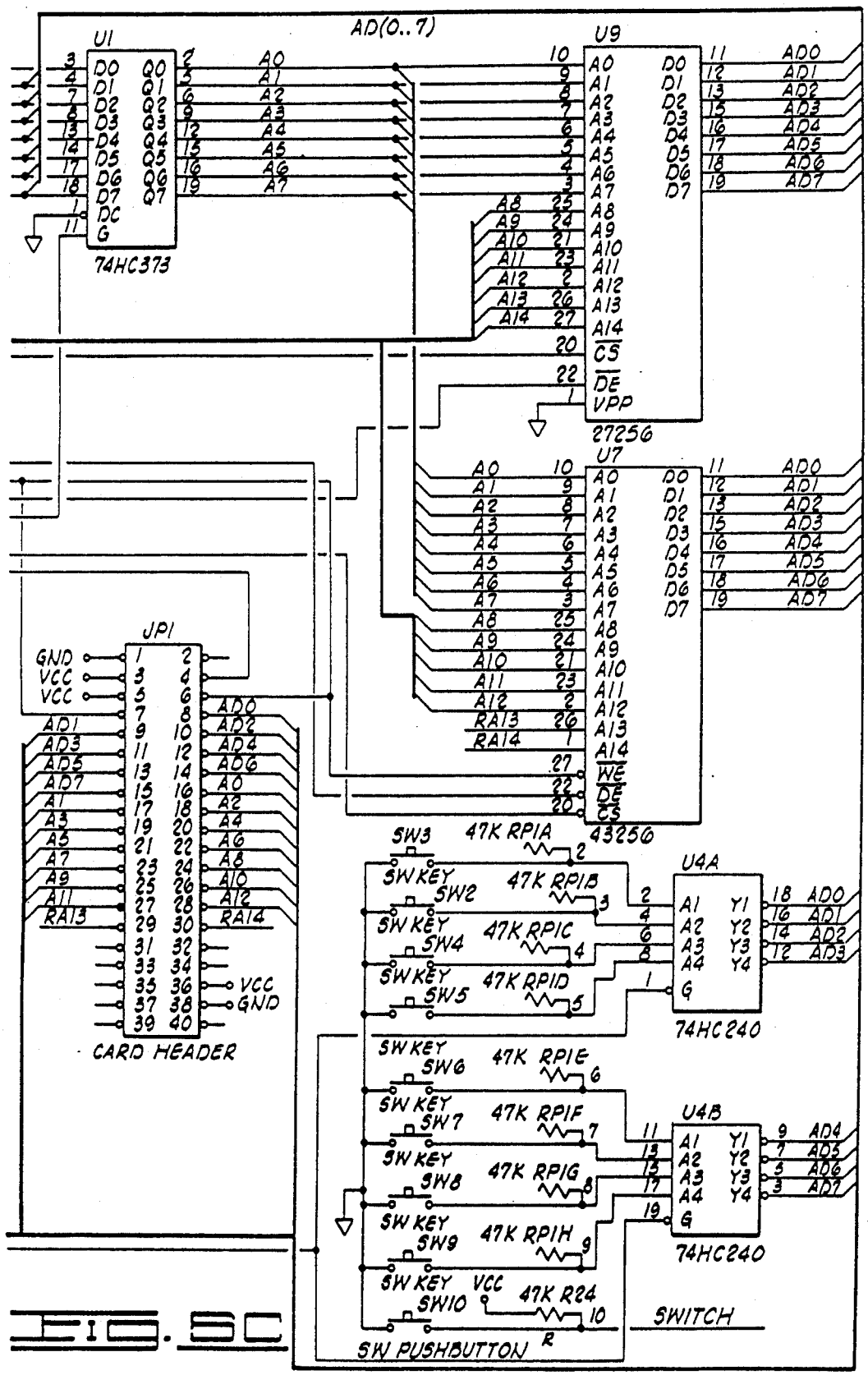
Figure 5D:
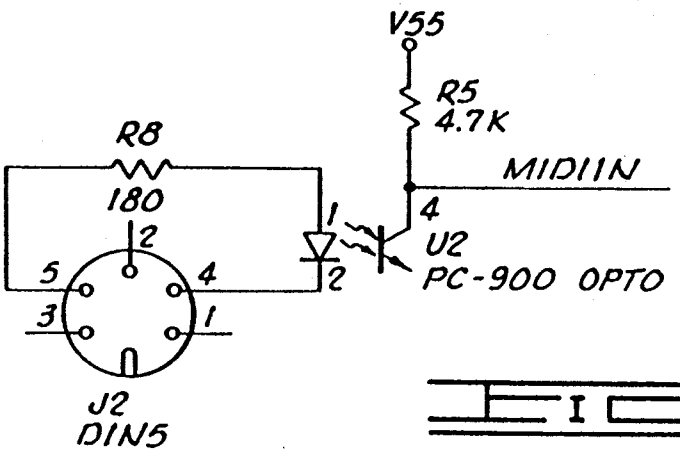
Figure 5E:
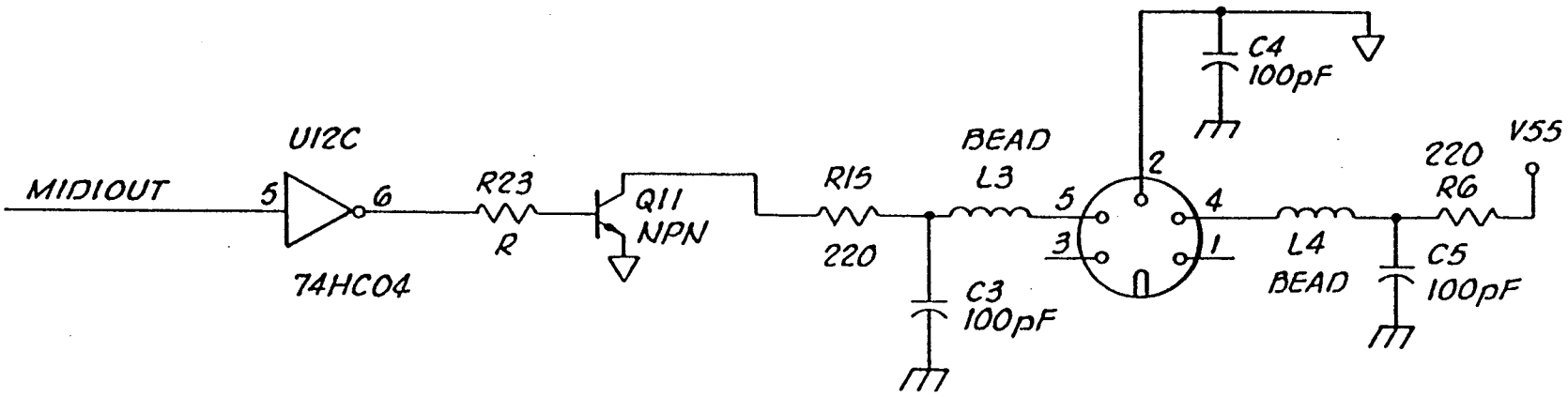

FIG. 4 is a block diagram of hardware for a guitar emulating device 10 for implementing the above referred to operating program of the invention. The device 10 is based upon a microprocessor 12. Suitable for the microprocessor 12 is an Intel 8031 which is an 8 bit IC with 128 bytes of internal RAM and on device input and output UARTs. Input 14 corresponds to a standard MIDI input device shown in greater detail in FIG. 5D. Output 16 corresponds to a standard MIDI output device shown in FIG. 5E. Since the input and output devices 14 and 16 follow the MIDI standard they allow for connection of the device 10 to other devices as, for instance, a keyboard input device and an audio output device based upon the MIDI standard.

The device 10 utilizes a bus 18 which is an 8 bit bus corresponding to the 8 bit microprocessor 12. Program control is stored on EPROM 20 which can be as, for instance, a 32K 27256 device. A CMOS RAM 22 can be selected as a 32K 43256 device.

Address latch 24 is used to select low addresses for the ROM 20 and the RAM 22 for separating data information from message information on the MIDI.

An address decoder 26 is utilized for selecting RAM 22, an LED driver 28, a switch buffer 30 or an optional secondary memory as, for instance, a cassette card or floppy drive generally indicated at 32. The LED driver 28 is an appropriate multiplex LED driver for controlling a LED array 34 for signaling output from the device and the switch buffer 30 interfaces with a switch array 36 for selecting different protocols for implementation the guitar emulator on the device 10.

FIGS. 5A, 5B, 5C, 5D and 5E show a more detailed layout of hardware corresponding to the device 10.

From the foregoing description and the following claims, the terms, emulator and emulation, have been meant and used in the broadest sense so as to include synthesizers and controllers where the latter incorporate the described emulating functions. Revoicing, as used herein, is also to be taken in a broad sense to include the transposition of at least one note to create a new voicing simulating a guitar or other instrument voicing, and usually having, therefor, a range greater than the original input chord. From these premises, and from the description herein, it is to be understood that te inventive concepts of the present disclosure are immediately applicable to the revoicing and emulation of a wide variety of instruments, and that the examples herein given with respect to the guitar should not be taken in alimiting sense, but in an illustrative sense.

What is claimed is:

1. A method of electronically generating a guitar like sound which comprises:

generating electrical input signals in response to playing of chords on a keyboard input device;

collecting said input signals within a time window;

assembling said collected signals into a note list;

outputing signals from said note list to an output audio generation device as a time displaced serial signal stream wherein the time displacement of the output signals from said note list is greater than said time window.

2. The method of claim 1 further including:

outputing signal from said note list in an order based on the pitch of the notes in said note list.

3. The method of claim 1 further including:

expanding said note list to include further notes, said further notes having the same pitch as notes collected in said note list but having octave displacements with respect to said notes in said note list.

4. An emulator for producing a guitar style performance from signals received from a non-guitar style controller, comprising:

input means for serially receiving electronic note signals from the controller regardless of whether the note signals arise in response to simultaneous multiple actuation of the controller or sequential actuation of the controller;

digital computer means for identifying a set of the serially received note signals as chord note signals in response to determining the respective note signals of the set are received within a predetermined time window and for generating a group of successively delayed strum note signals characteristic of a guitar style in response to said identified chord note signals; and output means for serially outputing the strum note signals to a sound generator during a time period longer than the predetermined time window.

5. An emulator as defined in claim 4, wherein said digital computer means includes means for determining whether identified chord note signals are within a predetermined range and for outputing in an unaltered state any such chord note signal not within the predetermined range.

6. An emulator as defined in claim 4, wherein a set of the serially received electronic note signals identified as chord note signals has a voicing of no more than five note signals playable by one hand at one time, and wherein said digital computer means includes means for expanding the voicing of such set of chord signals to a further range of notes up to the number of strings of the emulated guitar.

7. An emulator as defined in claim 4, wherein said digital computer means includes means for transposing one or more notes in a respective set of chord note signals from a base range of notes to a different range of notes and wherein said different range is indicative of reconfiguring the base tuning of guitar strings.

8. A device for producing a stringed instrument style performance, comprising:

input means for connecting to a piano style keyboard so that said input means receives electronic output signals produced by the keyboard to characterize musical notes in response to manual actuation of keys of the keyboard, wherein the electronic output signals produced in response to both sequentially and simultaneously actuated keys of the piano style keyboard are transmitted serially from the keyboard and received serially by said input means in a predetermined standard protocol;

a programmed microprocessor-based digital computer, including means for identifying a set of the serially received electronic output signals as chord note signals in response to determining the respective signals of the set are received within a predetermined time window and for generating a group of successively delayed strum note signals characteristic of a stringed instrument style in response to said identified chord note signals; and output means for serially outputing the strum note signals to a sound generator during a time period longer than the predetermined time window.

9. A device as defined in claim 8, wherein said digital computer further includes means for determining whether identified chord note signals are within a predetermined range and for outputing in an unaltered state any such chord note signal not within the predetermined range.

10. A device as defined in claim 8, wherein a set of the serially received electronic output signals identified as chord note signals has a voicing of no more than five notes playable from the keyboard by one hand at one time, and wherein said digital computer further includes means for expanding the voicing of such set of chord signals to a further range of notes up to the number of strings of the stringed instrument.

11. A device as defined in claim 8, wherein said digital computer further includes means for transposing one or more notes in a respective set of chord note signals from a base range of notes to a different range of notes and wherein said different range is indicative of reconfiguring the base tuning of the strings of the stringed instrument.

* * * * *